US011365694B2

(12) United States Patent
Sugiura

(10) Patent No.: US 11,365,694 B2
(45) Date of Patent: Jun. 21, 2022

(54) EVAPORATED FUEL PROCESSING DEVICE AND CONTROL DEVICE

(71) Applicant: AISAN KOGYO KABUSHIKI KAISHA, Obu (JP)

(72) Inventor: Masanori Sugiura, Toyoake (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/629,771

(22) PCT Filed: Jun. 19, 2018

(86) PCT No.: PCT/JP2018/023344
§ 371 (c)(1),
(2) Date: Jan. 9, 2020

(87) PCT Pub. No.: WO2019/012927
PCT Pub. Date: Jan. 17, 2019

(65) Prior Publication Data

US 2020/0173382 A1 Jun. 4, 2020

(30) Foreign Application Priority Data

Jul. 14, 2017 (JP) ..... JP2017-138337

(51) Int. Cl.
*F02D 41/00* (2006.01)
*F02M 25/08* (2006.01)

(52) U.S. Cl.
CPC ..... *F02D 41/004* (2013.01); *F02D 41/0045* (2013.01); *F02M 25/0836* (2013.01)

(58) Field of Classification Search
CPC ..... F02D 41/004; F02D 41/0045; F02D 2041/0265; F02D 2200/0804;
(Continued)

(56) References Cited

U.S. PATENT DOCUMENTS 4,630,581 A 12/1986 Shibata
9,897,044 B2 2/2018 Tanaka et al.
2016/0230707 A1* 8/2016 Tanaka ..... F01N 3/20

FOREIGN PATENT DOCUMENTS

JP 59188021 A * 10/1984 ..... F01N 13/0097
JP S59-188021 A 10/1984
(Continued)

OTHER PUBLICATIONS

Okino, Exhaust Gas Purifying Device in Engine, JP 59188021A (Year: 1984).*
(Continued)

*Primary Examiner* — Scott A Reinbold
(74) *Attorney, Agent, or Firm* — Shumaker, Loop & Kendrick, LLP

(57) ABSTRACT

An evaporated fuel processing device includes a canister; a purge passage connecting the canister and an intake pipe of an engine; a purge control valve on the purge passage; and a controller that controls switching timings for the purge control valve and a fuel injection valve that supplies fuel to the engine. The controller estimates whether a catalyst temperature would exceed a criteria temperature if the purge gas is supplied to the engine while the engine is in operation and a fuel supply from the fuel tank to the engine is stopped, and in a case where the catalyst temperature is estimated to exceed the criteria temperature, the controller reduces the purge gas amount before the fuel supply to the engine is stopped such that the catalyst temperature becomes equal to or lower than the criteria temperature when the fuel supply to the engine is stopped.

9 Claims, 11 Drawing Sheets

(58) Field of Classification Search
CPC ..... F02D 41/0032; F02D 2041/1412; F02D 41/123; F02D 41/04; F02D 19/0621; F02D 41/003; F02D 41/0037; F02D 41/0042; F02M 25/0836; F02M 25/08; F02M 25/0854; F02M 25/0872; F02M 25/089
USPC ..... 123/520
See application file for complete search history.

(56) References Cited

FOREIGN PATENT DOCUMENTS

| | | | |
|---|---|---|---|
| JP | S61-038153 | A | 2/1986 |
| JP | 2004-076673 | A | 3/2004 |
| JP | 2010-100192 | A | 5/2010 |
| JP | 2014-015846 | A | 1/2014 |
| JP | 2016-148251 | A | 8/2016 |

OTHER PUBLICATIONS

International Search Report (ISR) for PCT/JP2018/023344 dated Jul. 31, 2018 (4 pages total including English translation).
Written Opinion for PCT/JP2018/023344 dated Jul. 31, 2018 (9 pages).

* cited by examiner

FIG. 4

| Purge Gas Flowrate / Purge Gas Concentration | 0 | a1 | a2 | a3 | a4 | a5 | a6 | a7 | a8 |
|---|---|---|---|---|---|---|---|---|---|
| 0 | 0 | 0 | 0 | 0 | 0 | 0 | 0 | 0 | 0 |
| b1 | 0 | C1 | C2 | C3 | C4 | C5 | C6 | C7 | C8 |
| b2 | 0 | D1 | D2 | D3 | D4 | D5 | D6 | D7 | D8 |
| b3 | 0 | E1 | E2 | E3 | E4 | E5 | E6 | E7 | E8 |
| b4 | 0 | F1 | F2 | F3 | F4 | F5 | F6 | F7 | F8 |
| b5 | 0 | G1 | G2 | G3 | G4 | G5 | G6 | G7 | G8 |
| b6 | 0 | H1 | H2 | H3 | H4 | H5 | H6 | H7 | H8 |
| b7 | 0 | I1 | I2 | I3 | I4 | I5 | I6 | I7 | I8 |
| b8 | 0 | J1 | J2 | J3 | J4 | J5 | J6 | J7 | J8 |

FIG. 11

| Excess Temperature ΔT4 | <0 | 0 | d1 | d2 | d3 | d4 | d5 | d6 | d7 | d8 |
|---|---|---|---|---|---|---|---|---|---|---|
| Fuel Increasing Coefficient α | 1 | 1 | E1 | E2 | E3 | E4 | E5 | E6 | E7 | E8 |

EVAPORATED FUEL PROCESSING DEVICE AND CONTROL DEVICE

TECHNICAL FIELD

The disclosure herein discloses a technique relating to an evaporated fuel processing device and a controller configured to control an evaporated fuel supply and a fuel supply.

BACKGROUND ART

Techniques that supply gas containing evaporated fuel (purge gas) generated in a fuel tank to an engine and process the gas by combusting it are known. Japanese Patent Application Publication No. S61-38153 describes a controller that controls a purge gas supply to an engine. Hereinbelow, Japanese Patent Application Publication No. S61-38153 will be termed Patent Document 1. In Patent Document 1, in a case where an engine is in operation and a fuel supply to the engine from a fuel tank is stopped while a vehicle decelerates (in a case of fuel cut-off), the purge gas supply to the engine is also stopped at the same time when the fuel supply is stopped. Patent Document 1 stops the fuel supply and the purge gas supply simultaneously to suppress purge gas that has not been combusted (uncombusted purge gas) from being supplied to a catalyst. Contact of the uncombusted purge gas with the catalyst might result in an increase in a temperature of the catalyst.

SUMMARY OF INVENTION

Patent Document 1 stops the purge gas supply simultaneously with the fuel cut-off, by which the purge gas is not supplied to an intake pipe after the fuel cut-off. However, some purge gas might remain in the intake pipe at the fuel cut-off. The remaining purge gas in the intake pipe travels to the catalyst without being combusted in the engine. As a result, the temperature of the catalyst might increase and exceed a criteria temperature (which is an upper-limit temperature for the catalyst to sufficiently exhibit its function). The disclosure herein provides a technique that suppresses an increase in a temperature of catalyst.

A first technique disclosed herein relates to an evaporated fuel processing device. The evaporated fuel processing device may comprise: a canister configured to adsorb evaporated fuel generated in a fuel tank; a purge passage connecting the canister and an intake pipe of an engine, and through which purge gas to be delivered from the canister to the intake pipe flows; a purge control valve provided on the purge passage and configured to switch between a supply state in which the purge gas is supplied from the canister to the intake pipe and a cutoff state in which supply of the purge gas from the canister to the intake pipe is cut off; and a controller configured to control a timing to switch the purge control valve and a timing to switch a fuel injection valve configured to supply fuel to the engine. The controller may estimate whether a temperature of a catalyst would exceed a criteria temperature if the purge gas is supplied to the engine in a state where the engine is in operation and a fuel supply from the fuel tank to the engine is stopped, and in a case where the temperature of the catalyst is estimated to exceed the criteria temperature, the controller may reduce an amount of the purge gas before the fuel supply to the engine is stopped such that the temperature of the catalyst becomes equal to or lower than the criteria temperature when the fuel supply to the engine is stopped.

A second technique disclosed herein is the evaporated fuel processing device according to the first technique, wherein in the case where the temperature of the catalyst is estimated to exceed the criteria temperature, the controller may delay a timing to stop the fuel supply to the engine relative to a timing to stop a purge gas supply to the intake pipe.

A third technique disclosed herein is the evaporated fuel processing device according to the first or second technique, wherein in the case where the temperature of the catalyst is estimated to exceed the criteria temperature, the controller may stop a purge gas supply to the intake pipe.

A fourth technique disclosed herein relates to a controller. The controller may be configured to control an evaporated fuel processing means and a fuel supply means. The evaporated fuel processing means may supply evaporated fuel generated in a fuel tank to an intake pipe of an engine, and the fuel supply means may supply fuel in the fuel tank to the engine. The controller may be configured to: estimate whether a temperature of a catalyst would exceed a criteria temperature if purge gas is supplied to the engine in a state where the engine is in operation and a fuel supply from the fuel tank to the engine is stopped, and in a case where the temperature of the catalyst is estimated to exceed the criteria temperature, reduce an amount of the purge gas before the fuel supply to the engine is stopped such that the temperature of the catalyst becomes equal to or lower than the criteria temperature when the fuel supply to the engine is stopped.

A fifth technique disclosed herein relates to an evaporated fuel processing device. The evaporated fuel processing device may comprise a canister configured to adsorb evaporated fuel generated in a fuel tank; a purge passage connecting the canister and an intake pipe of an engine, and through which purge gas to be delivered from the canister to the intake pipe passes; a purge control valve provided on the purge passage and configured to switch between a supply state in which the purge gas is supplied from the canister to the intake pipe and a cutoff state in which supply of the purge gas from the canister to the intake pipe is cut off; and a controller configured to control a timing to switch the purge control valve and a timing to switch a fuel injection valve configured to supply fuel to the engine. The controller may estimate whether a temperature of a catalyst would exceed a criteria temperature if the purge gas is supplied to the engine in a state where the engine is in operation and a fuel supply from the fuel tank to the engine is stopped. In a case where the temperature of the catalyst is estimated to exceed the criteria temperature, the controller may increase an amount of the fuel supply to the engine to decrease the temperature of the catalyst such that the temperature of the catalyst becomes equal to or lower than the criteria temperature when the fuel supply to the engine is stopped.

A sixth technique disclosed herein relates to a controller. The controller may be configured to control an evaporated fuel processing means and a fuel supply means. The evaporated fuel processing means may supply evaporated fuel generated in a fuel tank to an intake pipe of an engine, and the fuel supply means may supply fuel in the fuel tank to the engine. The controller may be configured to: estimate whether a temperature of a catalyst would exceed a criteria temperature if purge gas is supplied to the engine in a state where the engine is in operation and a fuel supply from the fuel tank to the engine is stopped, and in a case where the temperature of the catalyst is estimated to exceed the criteria temperature, increase an amount of the fuel supply to the engine to decrease the temperature of the catalyst such that the temperature of the catalyst becomes equal to or lower than the criteria temperature when the fuel supply to the engine is stopped.

Advantageous Effects of Invention

According to the first technique, the temperature of the catalyst that would be obtained if the fuel supply to the engine is stopped (if the fuel cut-off is executed) while the fuel is supplied to the engine is estimated, and an amount of the purge gas is adjusted (reduced) in advance such that the estimated temperature of the catalyst (estimated catalyst temperature) does not exceed the criteria temperature. As a result, when the fuel cut-off is actually executed, the purge gas by which the temperature of the catalyst would be caused to exceed the criteria temperature is not present in the intake pipe. This can prevent the temperature of the catalyst from increasing and to exceeding the criteria temperature.

According to the second technique, in the case where the estimated catalyst temperature exceeds the criteria temperature, the engine continues to combust the fuel for a while after the purge gas supply to the intake pipe has been stopped. The purge gas that is present in the intake pipe when the purge gas supply is stopped is combusted together with the fuel in the engine for a while. Therefore, an amount of the purge gas in the intake pipe when the fuel cut-off is executed can be reduced.

According to the third technique, in the case where the estimated catalyst temperature exceeds the criteria temperature, the purge gas supply to the intake pipe is stopped, by which the temperature of the catalyst can be suppressed from increasing when the fuel cut-off is executed. That is, the estimated catalyst temperature can be maintained at the criteria temperature or lower substantially at all times. Therefore, regardless of when the fuel cut-off is executed, the temperature of the catalyst can be maintained at the criteria temperature or lower.

According to the fourth technique, the first to third techniques can be implemented.

According to the fifth technique, in the case where the estimated catalyst temperature exceeds the criteria temperature, an amount of the fuel supplied to the engine is increased to decrease the temperature of the catalyst. As a result, the estimated catalyst temperature can be maintained at the criteria temperature or lower. Regardless of when the fuel cut-off is executed, the temperature of the catalyst can be maintained at the criteria temperature or lower.

According to the sixth technique, the fifth technique can be implemented.

BRIEF DESCRIPTION OF DRAWINGS

FIG. 4 shows a table indicating relationships between purge gas and catalyst temperature increase;

FIG. 11 shows a table indicating relationships between estimated catalyst temperatures and fuel increase coefficients.

DETAILED DESCRIPTION

Figure 1:
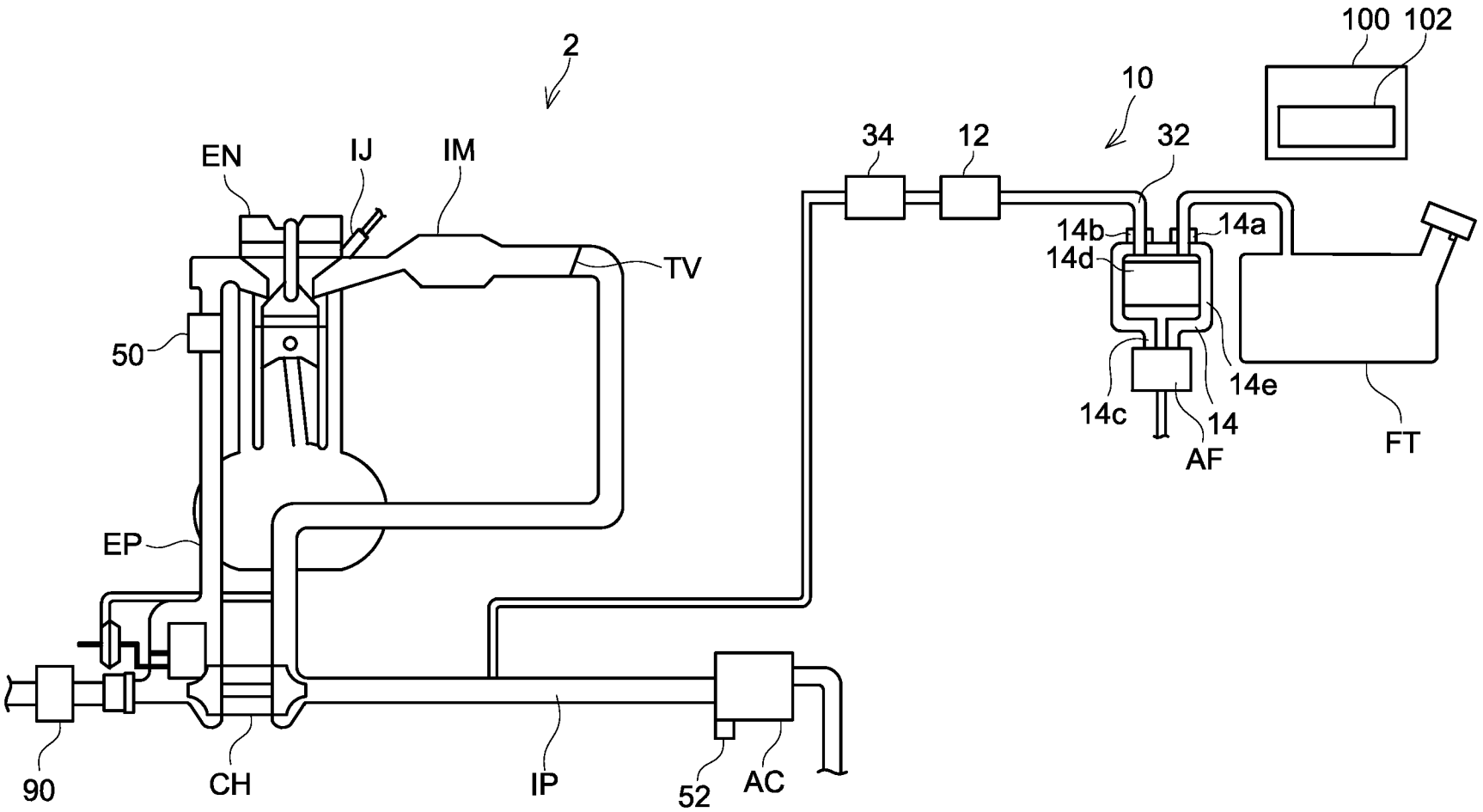
FIG. 1 shows a fuel supply system of a vehicle with an evaporated fuel processing device.

With reference to the drawings, an evaporated fuel processing device 10 will be described hereinbelow. As shown in FIG. 1, the evaporated fuel processing device 10 is installed in a vehicle such as an automobile, and is arranged in a fuel supply system 2 that is configured to supply fuel stored in a fuel tank FT to an engine EN.

(Fuel Supply System)

The fuel supply system 2 supplies the fuel pumped out from a fuel pump (not shown) housed in the fuel tank FT to an injector U. The injector IJ includes a solenoid valve whose aperture is adjusted by an ECU (Engine Control Unit) 100, which will be described later. The injector IJ injects the fuel to the engine EN. The injector IJ is a fuel supply means to the engine EN and is an example of fuel injection valve.

The engine EN is connected to an intake pipe IP and an exhaust pipe EP. The intake pipe IP is a pipe configured to supply air to the engine EN by a negative pressure in the engine EN or operation of a supercharger CH. A throttle valve TV is disposed in the intake pipe IP. The throttle valve TV adjusts an aperture of the intake pipe IP to control an amount of air flowing into the engine EN. The throttle valve TV is controlled by the ECU 100. The supercharger CH is disposed on upstream side relative to the throttle valve TV in the intake pipe IP. The supercharger CH is a so-called turbocharger, and is configured to rotate a turbine with gas discharged to the exhaust pipe EP from the engine EN to thereby compress the air in the intake pipe IP and supply the same to the engine EN. The supercharger CH is controlled by the ECU 100 to operate when an operation state of the engine EN enters a set range (e.g., engine rotational speed 2000 revolutions×engine load 20%)

An air cleaner AC is disposed on the upstream side relative to the supercharger CH of the intake pipe IP. The air cleaner AC includes a filter configured to remove foreign matter from air flowing into the intake pipe IP. In the intake pipe IP, air is suctioned through the air cleaner AC toward the engine EN when the throttle valve TV opens. The engine EN combusts the fuel and the air therein and discharges gas to the exhaust pipe EP after the combustion. The discharged gas from the engine EN is supplied to a catalyst 90 and discharged to outside after the catalyst 90 purifies it.

When the supercharger CH is not in operation, a negative pressure is generated in the intake pipe IP by the engine EN being driven. In a case where idling of the engine EN is stopped when the automobile stops or in a case where a motor is used to travel with the engine EN stopped as in a hybrid vehicle, in other words, in a case where driving of the engine EN is controlled for environmental perspectives, a negative pressure is not generated in the intake pipe IP by the engine EN being driven, or a small negative pressure is generated therein. On the other hand, when the supercharger CH is in operation, the upstream side relative to the supercharger CH has an atmospheric pressure, while downstream side relative to the supercharger CH has a positive pressure.

(Evaporated Fuel Processing Device)

The evaporated fuel processing device 10 is configured to supply evaporated fuel in the fuel tank FT to the engine EN through the intake pipe IP. The evaporated fuel processing device 10 includes a canister 14, a pump 12, a gas pipe 32, a purge control valve 34, and a controller 102 in the ECU 100. Evaporated fuel generated in the fuel tank FT is adsorbed in the canister 14. The canister 14 includes an activated charcoal 14*d* and a case 14*e* housing the activated charcoal 14*d*. The case 14*e* includes a tank port 14*a*, a purge port 14*b* and an open air port 14*c*. The tank port 14*a* is connected to an upper end of the fuel tank FT. Due to this, the evaporated fuel in the fuel tank FT flows into the canister 14. The evaporated fuel contained in gas flowing into the case 14*e* from the fuel tank FT adsorbed in the activated charcoal 14*d*. Due to this, the evaporated fuel can be prevented from being discharged to open air.

The open air port 14*c* communicates with the open air through an air filter AF. The air filter AF is configured to remove foreign matter from air flowing into the canister 14 through the open air port 14*c*. The purge port 14*b* communicates with the gas pipe 32. The gas pipe 32 is connected to the intake pipe IP on the upstream side relative to the supercharger CH. The gas pipe 32 is constituted of a flexible material, such as a rubber or a resin. The gas pipe 32 is an example of a purge passage.

The gas pipe 32 connects the canister 14 with the intake pipe IP. Gas containing the evaporated fuel in the canister 14 (purge gas) flows from the canister 14 into the gas pipe 32 through the purge port 14*b*. The purge gas in the gas pipe 32 is supplied to the intake pipe IP on the upstream side relative to the supercharger CH. The purge gas is delivered from the canister 14 to the intake pipe IP through the gas pipe 32.

The pump 12 is disposed on the gas pipe 32. The pump 12 is disposed between the canister 14 and the intake pipe IP. As the pump 12, a so-called vortex pump (also referred to as a cascade pump or a Wesco pump) or a centrifugal pump is used, for example. The pump 12 is controlled by the controller 102. An inlet of the pump 12 communicates with the canister 14 via the gas pipe 32. An outlet of the pump 12 is coupled to the intake pipe IP on the upstream side relative to the supercharger CH via the gas pipe 32.

The purge control valve 34 is disposed on the gas pipe 32. The purge control valve 34 is disposed between the pump 12 and the intake pipe IP. When the purge control valve 34 is in a closed state, the purge gas is blocked by the purge control valve 34. On the other hand, when the purge control valve 34 is opened, the purge gas flows into the intake pipe IP. That is, the purge control valve 34 switches between a supply state in which the purge gas is supplied from the canister 14 to the intake pipe IP and a cutoff state in which supply of the purge gas from the canister 14 to the intake pipe IP is cut off. The purge control valve 34 is a solenoid valve and is controlled by the controller 102.

(Controller)

The controller 102 is a part of the ECU 100, and is integrally disposed with other parts of the ECU 100 (e.g., part configured to control the engine EN). The controller 102 may be disposed separately from the other parts of the ECU 100. The controller 102 includes a CPU and a memory such as ROM and RAM. The controller 102 controls the evaporated fuel processing device 10 and the injector IJ in accordance with a program stored in the memory. Specifically, the controller 102 outputs a signal to the pump 12 to control the pump 12. The controller 102 outputs a signal to the purge control valve 34 to execute duty control. That is, the controller 102 adjusts a valve open time of the purge control valve 34 by adjusting a duty cycle of the signal outputted to the purge control valve 34. Further, the controller 102 outputs a signal to the injector IJ to control a fuel injection timing, as well. In some cases, the injector IJ may stop injecting the fuel (may execute the fuel cut-off) while the engine EN is in operation, according to the signal from the controller 102. The controller 102 controls a timing to switch the purge control valve 34 (to on or off) and a timing to switch the injector IJ (to on or off).

The ECU 100 is connected to an air-fuel ratio sensor 50 disposed in the exhaust pipe EP. The ECU 100 detects an air-fuel ratio in the exhaust pipe EP from a detection result of the air-fuel ratio sensor 50 and controls a fuel injection amount from the injector IJ.

The ECU 100 is further connected to an airflow meter 52 disposed near the air cleaner AC. The airflow meter 52 is a so-called hot wire airflow meter, however, it may be of other configuration. The ECU 100 receives a signal that indicates a detection result from the airflow meter 52 and detects an amount of gas suctioned to the engine EN.

(Purge Process)

While the engine EN is in operation, the purge gas can be supplied from the canister 14 to the engine EN. The purge gas is supplied to the intake pipe IP by driving the pump 12 and opening the purge control valve 34 with a predetermined aperture. While purge is executed (while the purge gas is supplied to the intake pipe IP), the purge control valve 34 is repeatedly opened and closed based on the duty cycle to adjust the supply amount of the purge gas to the intake pipe IP. The intake pipe IP has a negative pressure therein when the supercharger CH is not in operation, while the downstream side relative to the supercharger CH has a positive pressure when the supercharger CH is in operation. However, even when the supercharger CH is in operation, the upstream side relative to the supercharger CH has a negative pressure (or atmospheric pressure). By the gas pipe 32 being connected to the intake pipe IP on the upstream side relative to the supercharger CH, the purge gas can be delivered to the intake pipe IP regardless of operation state of the supercharger CH. A flow rate and concentration of the purge gas are calculated from a rotational speed of the pump 12, the aperture of the purge control valve 34 and a value of the air-fuel ratio sensor 50. The flow rate and concentration of the purge gas may be actually measured by attaching a flowmeter and a concentration meter to the gas pipe 32.

The purge gas supplied to the intake pipe IP is combusted in the engine EN together with the fuel supplied from the injector IJ. Exhaust gas after the combustion is purified by the catalyst 90 and then is discharged to the outside. In some cases, the fuel supply from the injector IJ to the engine EN may be stopped (the fuel cut-off may be executed) while the engine EN is in operation, for example, due to deceleration. In this case, the purge gas supply to the intake pipe IP is also stopped. However, when the purge gas supply is stopped simultaneously with the fuel cut-off or after the fuel cut-off, the purge gas (uncombusted purge gas) is supplied to the catalyst 90 and a temperature of the catalyst 90 thereby increases. In the evaporated fuel processing device 10, control described below is executed to prevent the temperature of the catalyst 90 from exceeding the catalyst criteria temperature. The control described below is executed by the controller 102.

(First Control Method)

Figure 2:
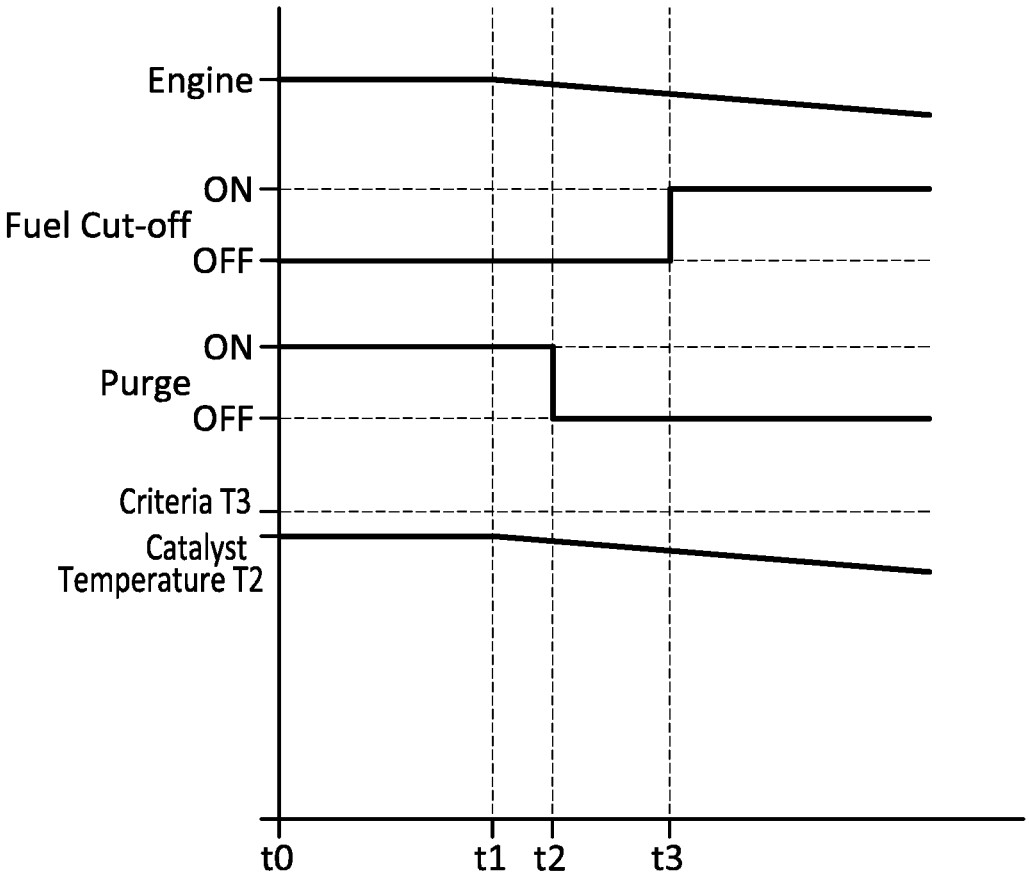
FIG. 2 shows a timing chart for respective parts of the vehicle according to a first control method.
Figure 3:
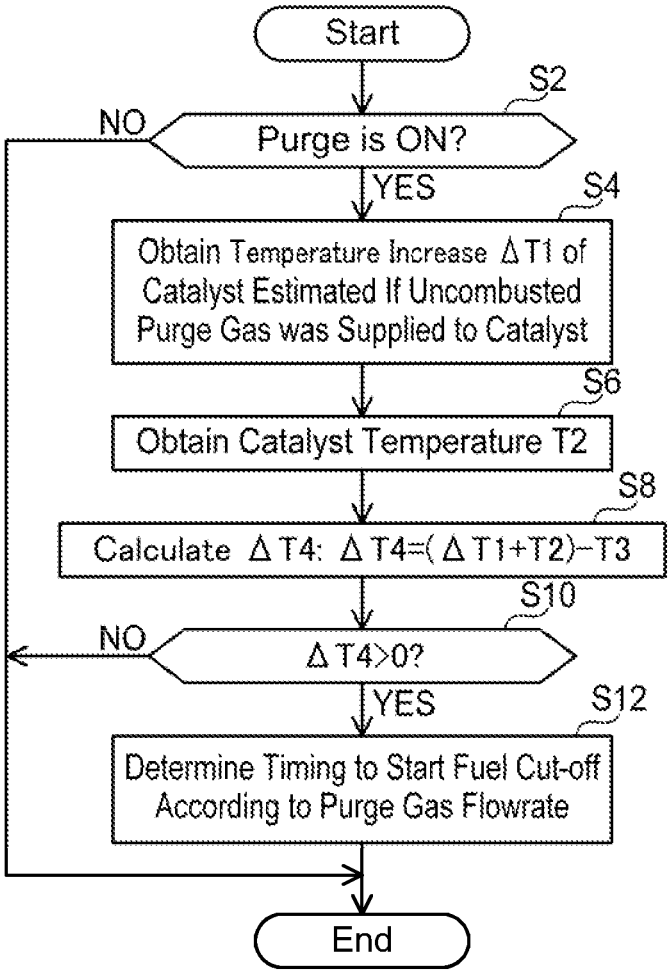
FIG. 3 shows a flow chart of the first control method.

With reference to FIGS. 2 to 4, a first control method will be described. In the first control method, in a case where the temperature of the catalyst 90 is estimated to exceed the criteria temperature due to the uncombusted purge gas, a timing for the fuel cut-off is delayed relative to its original timing to suppress generation of the uncombusted purge gas itself by combusting the purge gas in the intake pipe IP in the engine EN. FIG. 2 shows an engine rotational speed, whether the fuel cut-off is executed or not, whether the purge gas is supplied or not (whether the purge control valve 34 is on or off), and the temperature of the catalyst 90, in a situation where the traveling vehicle starts decelerating at timing t1.

FIG. 3 shows a process flow according to the first control method. This flow is executed every predetermined time (e.g., every 10 to 100 millisecond). In the evaporated fuel processing device 10, the flow is executed every 16 millisecond. As shown in FIG. 3, firstly the controller 102 determines whether a purge execution flag (flag for supplying the purge gas to the intake pipe IP) is on or not (step S2). In the evaporated fuel processing device 10, the first control is executed while the purge gas is supplied to the intake pipe IP. Therefore, in a case where the purge is not executed (step S2: NO), the present control is terminated. On the other hand, in a case where the purge is executed (step S2: YES), the controller 102 proceeds to step S4 and estimates how much the temperature of the catalyst 90 would be increased if the purge gas is supplied to the catalyst 90 without being combusted in the engine EN. That is, the controller 102 estimates a temperature increase ΔT1 of the catalyst 90 that would be caused if the uncombusted purge gas is supplied to the catalyst 90. In the evaporated fuel processing device 10, the controller 102 estimates the temperature increase ΔT1 of the catalyst 90 based on a table shown in FIG. 4.

With reference to FIG. 4, the temperature increase ΔT1 will be described. FIG. 4 shows the temperature increase ΔT1 of the catalyst 90 with respect to a purge gas flow rate and purge gas concentration supplied to the intake pipe IP (passing through the gas pipe 32). This table is stored in the controller 102. A value of the temperature increase ΔT1 becomes larger with a larger purge gas flow rate and a higher purge gas concentration. For example, C4 is larger than C3 as the value of the temperature increase ΔT1, and D3 is larger than C3 as the value of the temperature increase ΔT1. The purge gas flow rate and/or the purge gas concentration may be actually measured by attaching a gas concentration meter and/or a gas flowmeter to the gas pipe 32, or may be estimated from a value of the air-fuel ratio sensor 50, the rotational speed of the pump 12, the aperture (duty cycle) of the purge control valve 34, and the like.

The explanation on the flow of FIG. 3 is continued. After acquiring the temperature increase ΔT1 (step S4), the controller 102 acquires an actual temperature of the catalyst 90 (catalyst temperature T2) (step S6). The catalyst temperature T2 is estimated from the rotational speed and load of the engine EN. The catalyst temperature T2 may be actually measured by attaching a thermometer to the catalyst 90. Further, step S4 and step S6 may not be necessarily executed in this order.

Next, the controller 102 proceeds to step S8 and calculates an excess temperature ΔT4. The excess temperature ΔT4 is a value that is obtained by subtracting a criteria temperature T3 of the catalyst 90 from the temperature of the catalyst 90 that would be obtained if the uncombusted purge gas is supplied to the catalyst 90 (estimated catalyst temperature: ΔT1+T2), and thus is expressed as "ΔT4=(ΔT1+T2)−T3". In a case of "ΔT4≤0", the temperature of the catalyst 90 does not exceed the criteria temperature T3 even when the uncombusted purge gas is supplied to the catalyst 90. On the other hand, in a case of "ΔT4>0", the temperature of the catalyst 90 exceeds the criteria temperature T3 when the uncombusted purge gas is supplied to the catalyst 90.

In the case of "ΔT4≤0" (step S10: NO), the present control is terminated. In this case, the fuel cut-off is executed at any timing (at an original timing for the fuel cut-off). On the other hand, in the case of "ΔT4>0", the controller 102 determines a timing at which the fuel cut-off is to be executed (step S12). In the case of "ΔT4>0", the timing at which the fuel cut-off is to be executed (timing t3) is later than a timing at which the purge gas supply is stopped (timing t2) (see FIG. 2). The timing t3 is calculated from the table shown in FIG. 4.

As described above, the table of FIG. 4 shows the temperature increase ΔT1 of the catalyst 90 that is assumed if the uncombusted purge gas was supplied to the catalyst 90. This table is used to determine a purge gas flow rate that satisfies "ΔT4≤0". For example, in a case where "ΔT4=0" is satisfied when the temperature increase ΔT1 in FIG. 4 is F4, the timing t3 is determined such that a purge gas flow rate that is supplied to the catalyst 90 after the fuel cut-off becomes a3 or lower. The timing t3 may be set at a timing after all of the purge gas supplied to the intake pipe IP has been combusted in the engine EN, that is, after a timing at which the purge gas flow rate supplied to the catalyst 90 becomes "0". The timing t3 in FIG. 2 is the timing at which the purge gas flow rate supplied to the catalyst 90 becomes "0". Therefore, the purge gas that remained in the intake pipe IP when the purge was set to off (at the timing t2) has all been combusted in the engine EN, thus no uncombusted purge gas is supplied to the catalyst 90. As such, the catalyst temperature T2 decreases with the decrease in the rotational speed and load of the engine.

(Advantages of First Control Method)

In the above-described first control method, the timing at which the fuel cut-off is executed is set later than the timing at which the purge gas supply is stopped (timing at which the purge control valve 34 is switched to off). This allows the purge gas remaining in the intake pipe IP when the purge control valve 34 is closed to be combusted in the engine EN. As a result, no uncombusted purge gas is supplied and thus the temperature of the catalyst can be prevented from exceeding the criteria temperature. It should be noted that the above-described first control method is executed only when the catalyst temperature is estimated to exceed the criteria temperature due to the uncombusted purge gas, but is not executed every time the fuel cut-off is executed. That is, the first control method is not executed when the catalyst temperature does not exceed the criteria temperature even if the uncombusted purge gas is supplied to the catalyst. To simply prevent the temperature of the catalyst from reaching the criteria temperature, the timing for the fuel cut-off may be set later than the timing at which the purge control valve 34 is switched to off (the purge is set to off) at all times. However, setting the timing for the fuel cut-off to be later than the timing for the purge-off at all times may result in an increase in fuel consumption. As well as preventing the catalyst temperature from exceeding the criteria temperature, the above-described first control method can curb the fuel consumption.

(Second Control Method)

Figure 5:
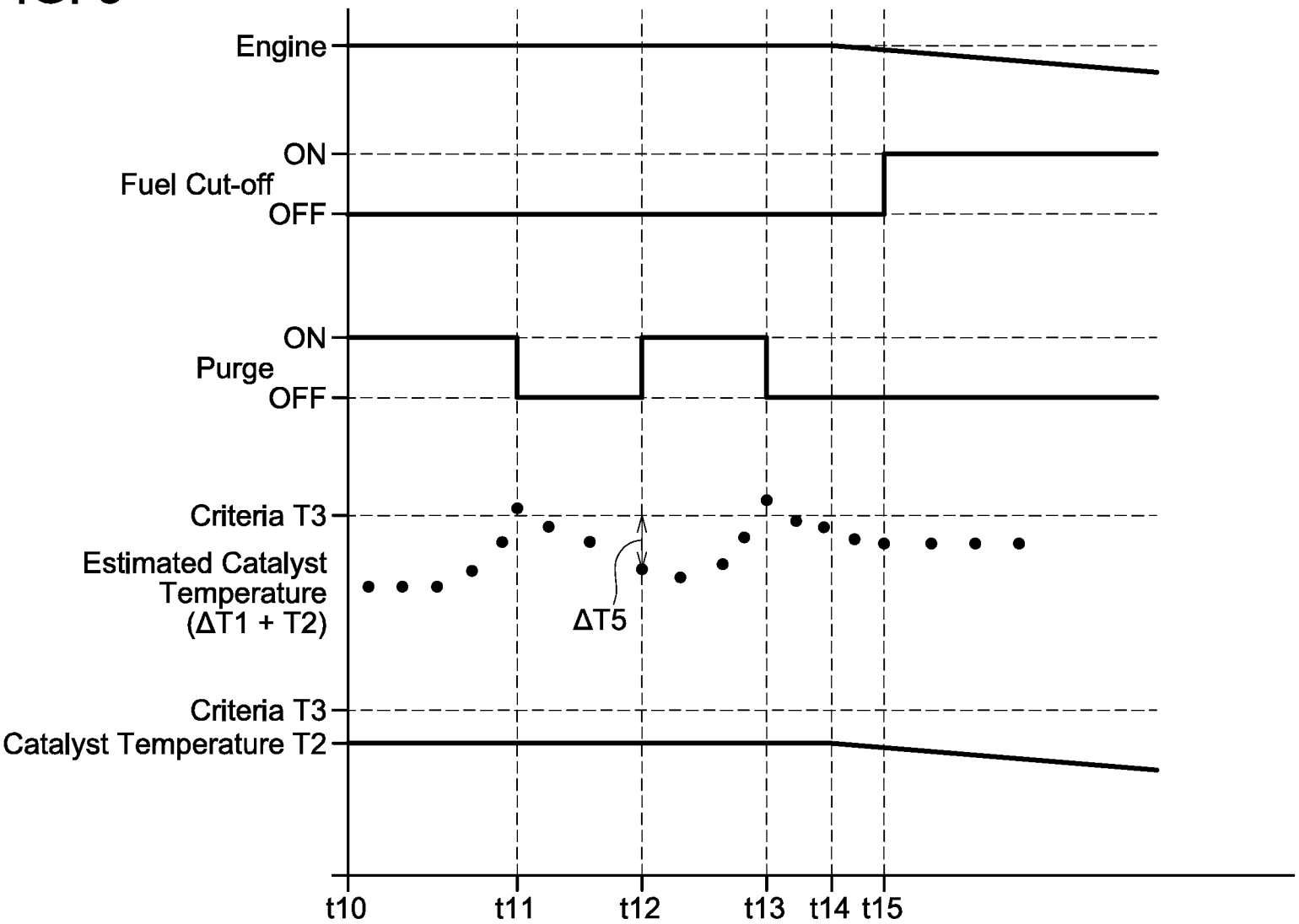
FIG. 5 shows a timing chart for the respective parts of the vehicle according to a second control method.
Figure 6:
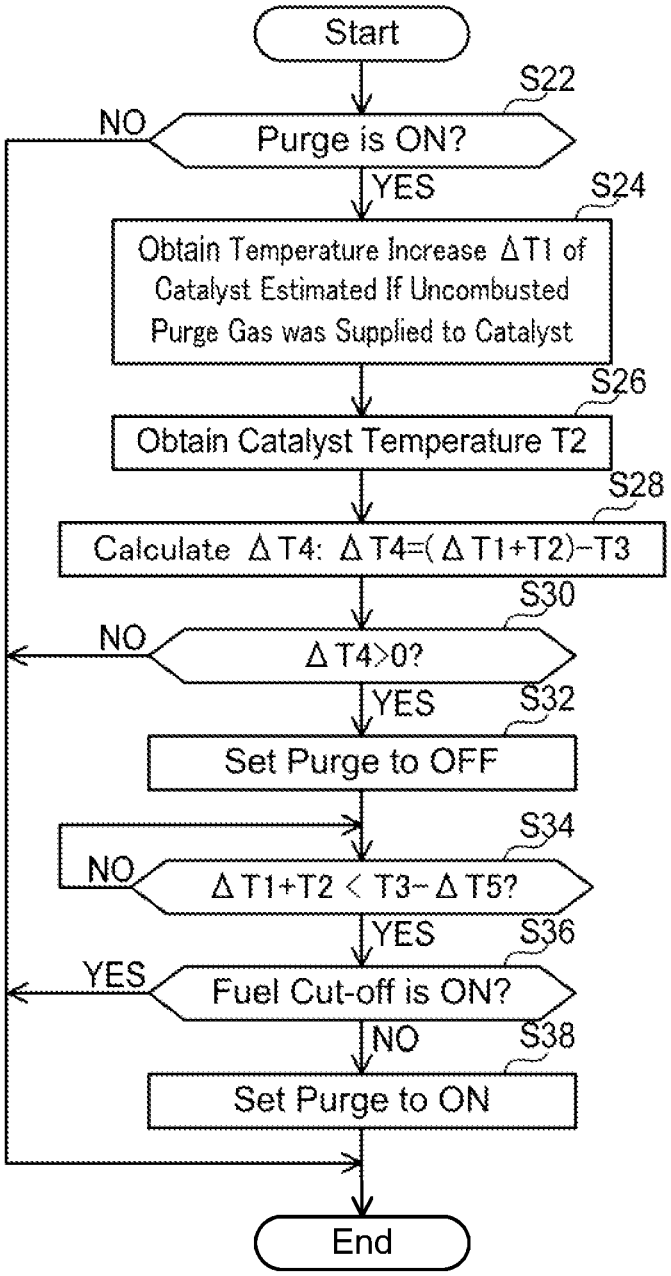
FIG. 6 shows a flow chart of the second control method.

With reference to FIGS. 5 and 6, a second control method will be described. The second control method is the same as the first control method in that the flow rate of the uncombusted purge gas itself is suppressed by the engine EN combusting the purge gas in the intake pipe IP in the case where the temperature of the catalyst 90 is estimated to exceed the criteria temperature due to the combusted purge gas. FIG. 5 shows an engine rotational speed, whether the fuel cut-off is executed or not, whether the purge gas is supplied or not (whether the purge control valve 34 is on or off), an estimated catalyst temperature (ΔT1+T2) and an actual catalyst temperature (T2), in a situation where the traveling vehicle starts decelerating at timing t14.

FIG. 6 shows a process flow of the second control method. This flow is executed every predetermined time (e.g., every 10 to 100 millisecond). In the evaporated fuel processing device 10, the flow is executed every 16 millisecond. As shown in FIG. 6, processes from step S22 to step S30 are substantially the same as the processes from step S2 to step S10 of FIG. 3. For this reason, description for the processes from step S22 to step S30 is omitted. The present control method is different from the first control method in processes from step S32 and afterward.

In a case where the estimated catalyst temperature (ΔT1+T2) exceeds the criteria temperature T3, that is, in the case of "ΔT4>0" (step S30: YES), the controller 102 closes the purge control valve 34 to stop the purge gas supply to the intake pipe IP (step S32). In the present control method, regardless of when the fuel cut-off is executed, the purge gas supply is stopped in a case where the catalyst temperature would exceed the criteria temperature (ΔT4>0) if the fuel cut-off was executed, even when the actual catalyst temperature T2 is lower than the criteria temperature T3. For example, as shown in FIG. 5, when the estimated catalyst temperature (ΔT1+T2) becomes lower than the criteria temperature T3 (timing t12) after the purge is set to off at timing t11, the purge gas supply is resumed. During the time period from the timing t11 to the timing t12, no fuel cut-off is executed.

In a case where the estimated catalyst temperature (ΔT1+T2) is equal to or higher than a purge resuming temperature (the criteria temperature T3—a predetermined value ΔT5) after the purge is set to off in step S32 (step S34: NO), the controller 102 keeps the purge gas supply stopped. That is, the controller 102 does not resume the purge immediately after the estimated catalyst temperature has become the criteria temperature T3 or lower, but keeps the purge gas supply stopped over a predetermined time period. In a case where the estimated catalyst temperature becomes lower than the purge resuming temperature (step S34: YES) and the fuel cut-off is not being executed (step S36: NO), the controller 102 resumes the purge gas supply (step S38, timing t12).

On the other hand, in a case where the estimated catalyst temperature becomes lower than the purge resuming temperature (step S34: YES) but the fuel cut-off is being executed (step S36: YES), the controller 102 does not resume the purge gas supply. That is, as shown in FIG. 5 from timing t13 and afterward, in a case where the purge is set to off at the timing t13, the rotational speed of the engine EN starts decreasing at timing t14 before the estimated catalyst temperature becomes lower than the purge resuming temperature, and the fuel cut-off is thereby executed at timing t15, the controller 102 keeps setting the purge off without resuming the purge gas supply.

(Advantage of Second Control Method)

In the second control method, the purge gas supply is stopped when the estimated catalyst temperature (ΔT1+T2) exceeds the criteria temperature T3, regardless of whether the fuel cut-off is executed or not. Therefore, the estimated catalyst temperature is maintained at the criteria temperature T3 or lower substantially at all times. The above-described second control method can suppress an increase in the temperature of the catalyst 90 by maintaining the estimated catalyst temperature at the criteria temperature T3 or lower at all times, without adjusting the timing for fuel cut-off.

(Third Control Method)

Figure 7:
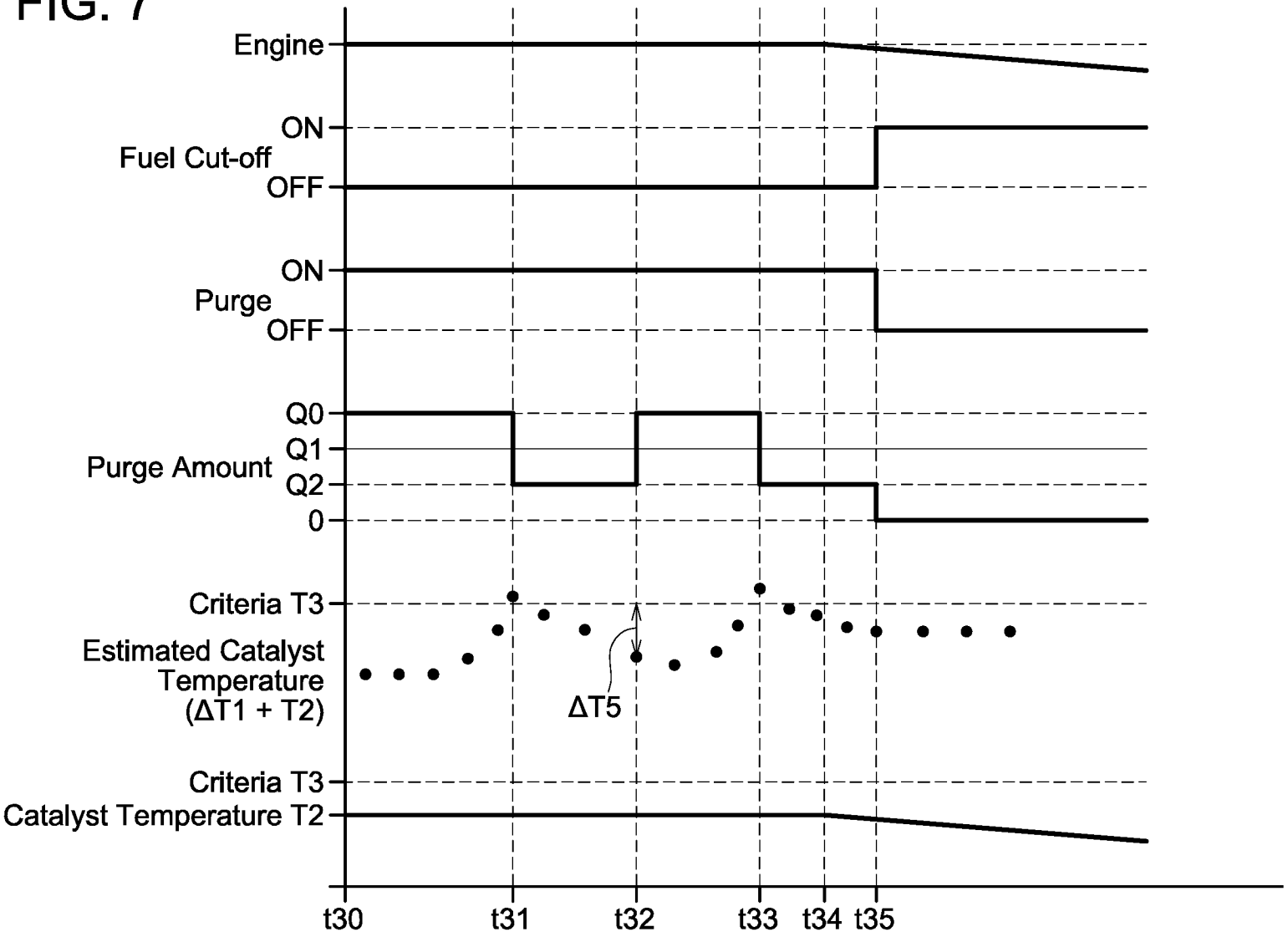
FIG. 7 shows a timing chart for the respective parts of the vehicle according to a third control method.
Figure 8:
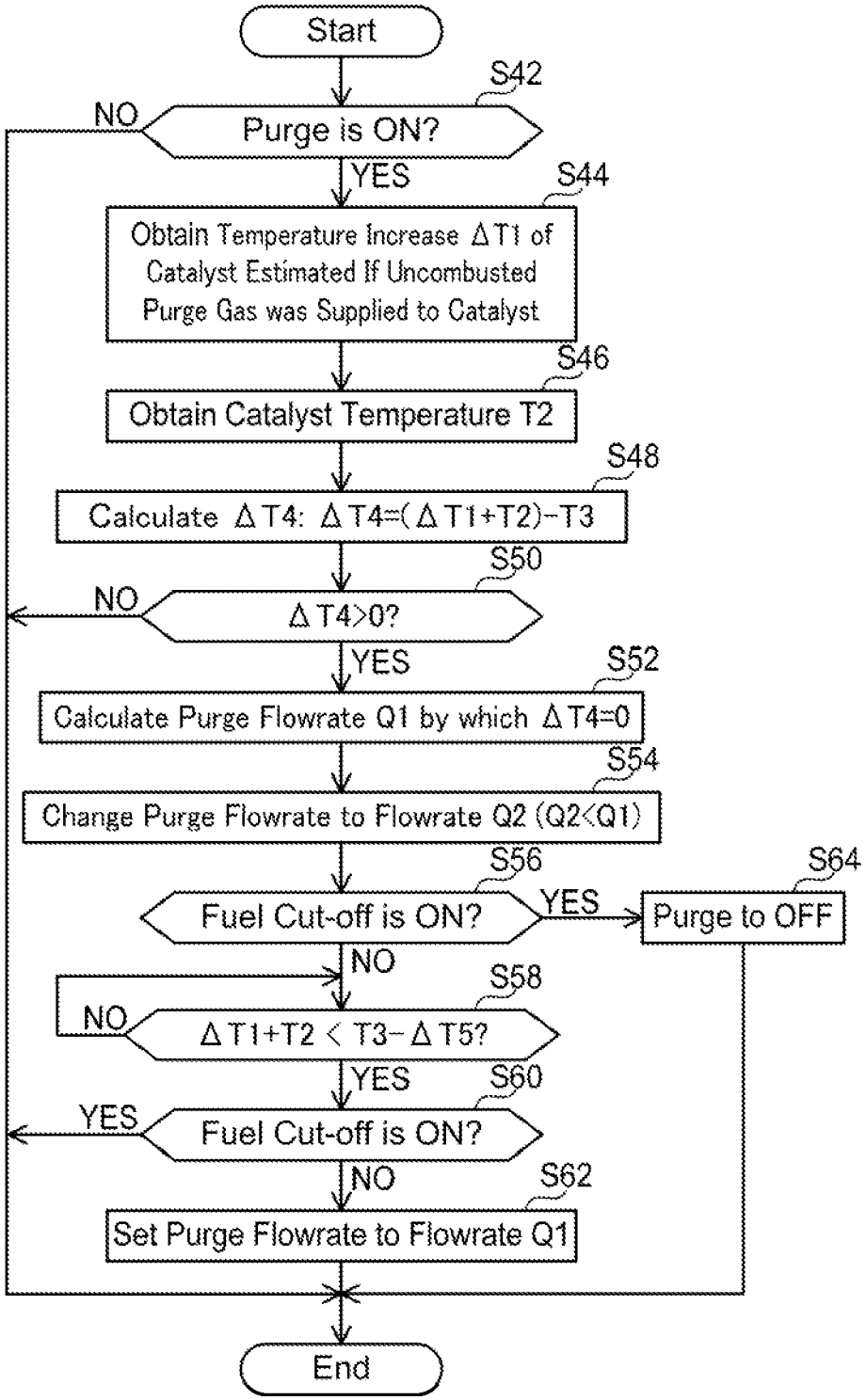
FIG. 8 shows a flow chart of the third control method.

With reference to FIGS. 7 and 8, a third control method will be described. The third control method is the same as the second control method in that the purge gas supply is controlled in a case where the temperature of the catalyst 90 exceeds the criteria temperature due to the uncombusted purge gas, regardless of when the fuel cut-off is executed. FIG. 7 shows an engine rotational speed, whether the fuel cut-off is executed or not, whether the purge gas is supplied or not (whether the purge control valve 34 is on or off), a purge gas supply amount, an estimated catalyst temperature (ΔT1+T2) and an actual catalyst temperature (T2), in a situation where the traveling vehicle starts decelerating at timing t34.

FIG. 8 shows a process flow of the third control method. This flow is executed every predetermined time (e.g., 10 to 100 millisecond). In the evaporated fuel processing device 10, the flow is executed every 16 millisecond. As shown in FIG. 8, processes from step S42 to step S50 are substantially the same as the processes from step S22 to step S30 of FIG. 6 (from step S2 to step S10 of FIG. 3). For this reason, description for the processes from step S42 to step S50 is omitted. The present method is different from the first and second control methods in processes from step S52 and afterward.

In a case where the estimated catalyst temperature (ΔT1+T2) exceeds the criteria temperature T3 and "ΔT4>0" is thereby satisfied (step S50: YES), the controller 102 calculates a flow rate Q1 by which "ΔT4=0" is satisfied (step S52). The flow rate Q11 is calculated from the table shown in FIG. 4. For example, in a case where "ΔT4>0" is satisfied with the current purge gas flow rate (control flow rate Q0) a7 and a purge gas concentration b2 (temperature increase ΔT1=D2), the controller 102 determines the purge gas flow rate Q1 (e.g., flow rate Q1=a5) that satisfies "ΔT4=0" with the purge gas concentration b2.

Next, the controller 102 changes the purge gas flow rate supplied to the intake pipe IP from the flow rate Q1 to a flow rate Q2 (e.g., flow rate Q2=a3) which is smaller than the flow rate Q1 (step S54, timings t31, t33), without stopping the purge gas supply. The purge gas flow rate is changed by controlling the duty cycle of the purge control valve 34.

While the purge gas is supplied at the flow rate Q2, the estimated catalyst temperature (ΔT1+T2) decreases (from timing t31 to timing t32, from timing t33 to timing t35). That is, while the purge gas is supplied at the flow rate Q2, the estimated catalyst temperature (ΔT1+T2) does not exceed the criteria temperature T3, thus "ΔT4<0" is satisfied. When the fuel cut-off is executed (step S56: YES, timing t35) after the purge gas flow rate is changed to the flow rate Q2, the controller 102 stops the purge gas supply (step S64). In a case where the fuel cut-off is not executed (step S56: NO) after the purge gas flow rate is changed to the flow rate Q2, the controller 102 maintains the flow rate Q2 while the estimated catalyst temperature (ΔT1+T2) is equal to or higher than a purge control resuming temperature (the criteria temperature T3—a predetermined value ΔT5) (step S58: No, from timing t31 to timing t32).

On the other hand, even in the case where the fuel cut-off is not executed (step S56: NO) after the purge gas flow rate is changed to the flow rate Q2, the controller 102 sets the purge gas flow rate back to the flow rate Q1 (step S62, timing t32) in a case where the estimated catalyst temperature (ΔT1+T2) becomes lower than the purge control resuming temperature (step S58: YES) and the fuel cut-off is not being executed (step S60: NO).

(Advantage of Third Control Method)

In the third control method, when the estimated catalyst temperature (ΔT1+T2) exceeds the criteria temperature T3, the purge gas supply amount is reduced to keep maintaining the estimated catalyst temperature not to exceed the criteria temperature, regardless of whether the fuel cut-off is executed or not. That is, in the third control method, the purge gas supply is continued even when the estimated catalyst temperature exceeds the criteria temperature. As such, as well as consuming the purge gas adsorbed in the canister 14, an increase in the temperature of the catalyst 90 can be suppressed without adjusting the timing for fuel cut-off.

(Fourth Control Method)

Figure 9:
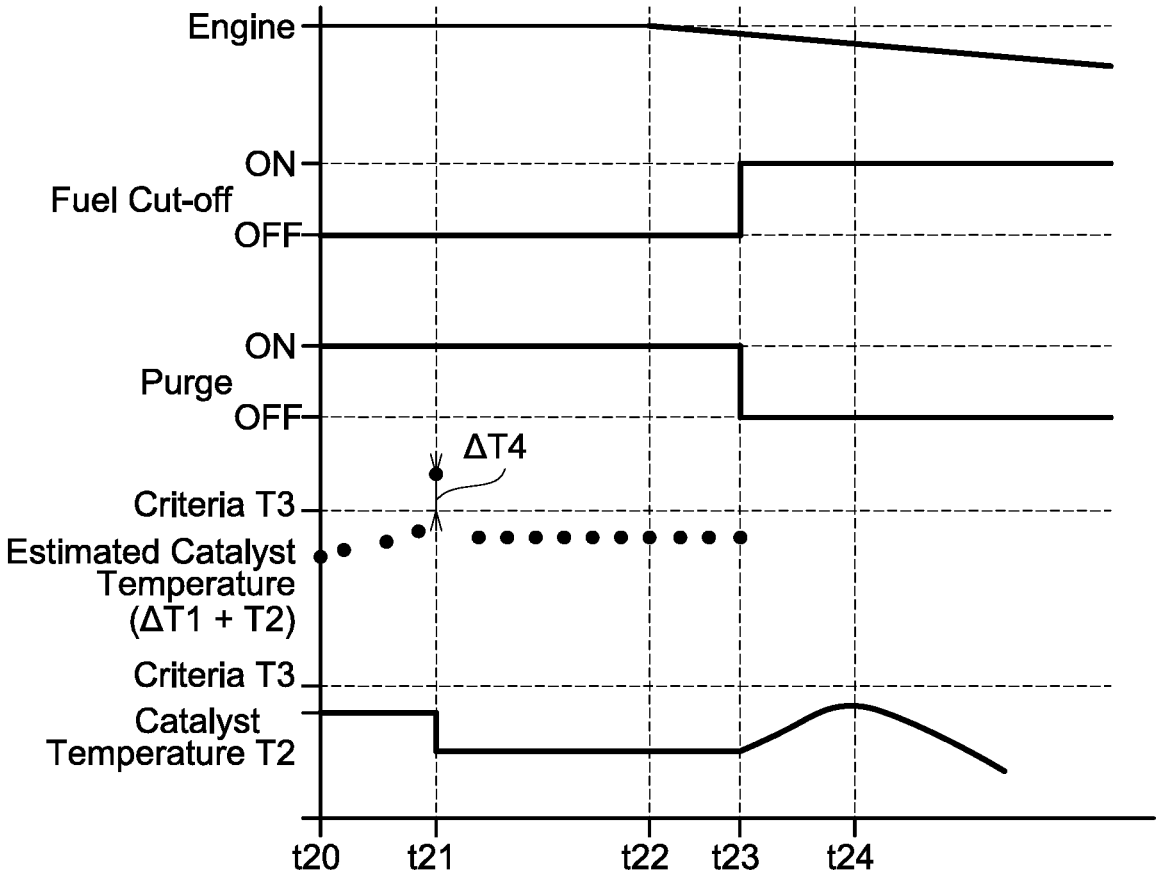
FIG. 9 shows a timing chart for the respective parts of the vehicle according to a fourth control method.
Figure 10:
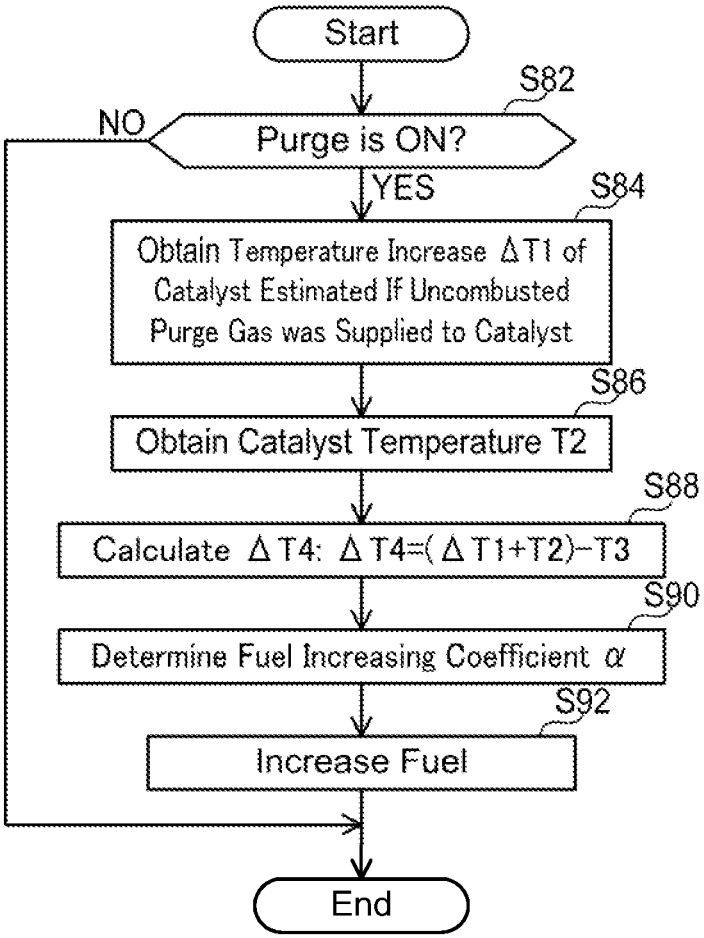
FIG. 10 shows a flow chart of the fourth control method.

With reference to FIGS. 9 to 11, a fourth control method will be described. The fourth control method is the same as the second control method in that an increase in the temperature of the catalyst 90 can be suppressed without adjusting the timing for fuel cut-off. FIG. 9 shows an engine rotational speed, whether the fuel cut-off is executed or not, whether the purge gas is supplied or not (whether the purge control valve 34 is on or off), an estimated catalyst temperature (ΔT1+T2) and an actual catalyst temperature (T2), in a situation where the traveling vehicle starts decelerating at timing t22.

FIG. 10 shows a process flow of the fourth control method. This flow is executed every predetermined time (e.g., every 10 to 100 millisecond). In the evaporated fuel processing device 10, the flow is executed every 16 millisecond. As shown in FIG. 10, processes from step S82 to step S88 are substantially the same as the processes from step S2 to step S8, the processes from step S22 to step S28, and the processes from step S42 to step S48. Thus, the description for the processes from step S82 to step S88 is omitted. The present control method is different from the first to third control methods in processes from step S88 and afterward.

As shown in FIG. 10, after calculating the excess temperature ΔT4 in step S88, the controller 102 determines a fuel increase coefficient α based on the excess temperature ΔT4 (step S90) and increases the fuel to be supplied to the engine EN based on the fuel increase coefficient α (step S92). The fuel increase coefficient α is calculated from a table shown in FIG. 11. Here, the fuel increase coefficient α means an increase rate by which the fuel supplied to the internal combustion (the engine) is increased when an exhaust temperature becomes high. Techniques that decrease a catalyst temperature by increasing fuel supplied to an internal combustion (engine) to decrease an exhaust temperature when the exhaust temperature becomes high and the catalyst temperature is thereby increased (fuel increasing techniques) are known. The present control method increases the fuel to decrease the catalyst temperature despite the catalyst temperature not actually increasing (despite no need to increase the fuel). The fuel increase coefficient α in FIG. 11 will be described later.

As shown in FIG. 9, when the estimated catalyst temperature (ΔT1+T2) exceeds the criteria temperature T3 at timing t21, the controller 102 increases the fuel supplied to the engine EN to decrease the catalyst temperature T2 even if the actual catalyst temperature T2 does not exceed the criteria temperature T3. As mentioned above, in this case, the fuel is not increased usually. As the actual catalyst temperature T2 decreases, the estimated catalyst temperature (ΔT1+T2) also decreases (from timing t21 and afterward). Due to this, the rotational speed of the engine EN decreases from timing t22, and the catalyst temperature T2 does not exceed the criteria temperature T3 even when the fuel cut-off is executed at timing t23 (see t24). As above, the present control method does not increase the fuel based on the actual catalyst temperature, but applies the fuel increasing technique with respect to the estimated catalyst temperature.

The fuel increase coefficient α shown in FIG. 11 will be described. The fuel increase coefficient α is set corresponding to the excess temperature ΔT4. Larger values are set as the fuel increase coefficient α for larger excess temperature ΔT4. For example, a larger value is set as E2 than a value of E1. Since the fuel is increased in the case where the estimated catalyst temperature (ΔT1+T2) exceeds the criteria temperature T3 (that is, in the case of ΔT4>0), the fuel increase coefficient α is "1" in the case of ΔT4≤0. In a case where the fuel has been already increased due to an increase in the actual catalyst temperature independently from the present control method, the fuel increase coefficient α is applied to the already-increased fuel.

(Advantage of Fourth Control Method)

In the fourth control method, there is no need to adjust timings for fuel cut-off and purge-off. Therefore, the fourth control method can suppress excessive consumption of the fuel and a decrease in processed amount of the purge gas.

Other Embodiments

As described above, the canister 14, the pump 12 and the purge control valve 34 are disposed in this order from the upstream of the purge passage (the gas pipe 32) to the downstream thereof, in the evaporated fuel processing device 10. However, this arrangement is merely an example, and the arrangement of the canister 14, the pump 12 and the purge control valve 34 disposed in the purge passage may be changed to any arrangement.

In the above-described embodiments, the evaporated fuel processing device 10 is applied to the fuel supply system including the supercharger CH. However, the technique disclosed herein, more specifically, the evaporated fuel processing device 10 or the controller 102 may be applied to a fuel supply system that does not include a supercharger.

The controller 102 in the above embodiments may be applied, solely or together with the ECU 100, to an existing fuel supply system.

The evaporated fuel processing device disclosed herein does not necessarily require a pump. The evaporated fuel processing device simply needs to include at least a canister, a purge passage connecting the canister with an intake pipe, a purge control valve disposed on the purge passage, and a controller having the above-described functions.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. An evaporated fuel processing device, comprising:

a canister configured to adsorb evaporated fuel generated in a fuel tank;

a purge passage connecting the canister and an intake pipe of an engine, and through which purge gas to be delivered from the canister to the intake pipe flows;

a purge control valve provided on the purge passage and configured to switch between a supply state in which the purge gas is supplied from the canister to the intake pipe and a cutoff state in which supply of the purge gas from the canister to the intake pipe is cut off; and a controller configured to control a timing to switch the purge control valve and a timing to switch a fuel injection valve configured to supply fuel to the engine, wherein while the engine is in operation with fuel supplied to the engine from the fuel tank, the controller estimates whether a temperature of a catalyst would exceed a criteria temperature on assumption that purge gas is supplied to the engine in a state where a fuel supply from the fuel tank to the engine is stopped, and in a case where the temperature of the catalyst is estimated to exceed the criteria temperature, the controller reduces an amount of the purge gas before the fuel supply to the engine is stopped such that the temperature of the catalyst becomes equal to or lower than the criteria temperature when the fuel supply to the engine is stopped.

2. The evaporated fuel processing device according to claim 1, wherein in the case where the temperature of the catalyst is estimated to exceed the criteria temperature, the controller delays a timing to stop the fuel supply to the engine relative to a timing to stop a purge gas supply to the intake pipe.

3. The evaporated fuel processing device according to claim 2, wherein in the case where the temperature of the catalyst is estimated to exceed the criteria temperature, the controller stops a purge gas supply to the intake pipe.

4. The evaporated fuel processing device according to claim 2, wherein in the case where the temperature of the catalyst is estimated to exceed the criteria temperature, the controller calculates an amount of the purge gas by which the temperature of the catalyst does not exceed the criteria temperature and reduces a supply amount of the purge gas to the calculated amount.

5. A controller configured to control an evaporated fuel processing means and a fuel supply means, wherein the evaporated fuel processing means supplies evaporated fuel generated in a fuel tank to an intake pipe of an engine, the fuel supply means supplies fuel in the fuel tank to the engine, and the controller is configured to:

while the engine is in operation with fuel supplied to the engine from the fuel tank, estimate whether a temperature of a catalyst would exceed a criteria temperature on assumption that purge gas is supplied to the engine in a state where a fuel supply from the fuel tank to the engine is stopped, and in a case where the temperature of the catalyst is estimated to exceed the criteria temperature, reduce an amount of the purge gas before the fuel supply to the engine is stopped such that the temperature of the catalyst becomes equal to or lower than the criteria temperature when the fuel supply to the engine is stopped.

6. An evaporated fuel processing device, comprising:

a canister configured to adsorb evaporated fuel generated in a fuel tank;

a purge passage connecting the canister and an intake pipe of an engine, and through which purge gas to be delivered from the canister to the intake pipe flows;

a purge control valve provided on the purge passage and configured to switch between a supply state in which the purge gas is supplied from the canister to the intake pipe and a cutoff state in which supply of the purge gas from the canister to the intake pipe is cut off; and a controller configured to control a timing to switch the purge control valve and a timing to switch a fuel injection valve configured to supply fuel to the engine, wherein while the engine is in operation with fuel supplied to the engine from the fuel tank, the controller estimates whether a temperature of a catalyst would exceed a criteria temperature on assumption that the purge gas is supplied to the engine in a state where a fuel supply from the fuel tank to the engine is stopped, and in a case where the temperature of the catalyst is estimated to exceed the criteria temperature, the controller increases an amount of the fuel supply to the engine before the fuel supply to the engine is stopped to decrease the temperature of the catalyst such that the temperature of the catalyst becomes equal to or lower than the criteria temperature when the fuel supply to the engine is stopped.

7. A controller configured to control an evaporated fuel processing means and a fuel supply means, wherein the evaporated fuel processing means supplies evaporated fuel generated in a fuel tank to an intake pipe of an engine, the fuel supply means supplies fuel in the fuel tank to the engine, and the controller is configured to:

while the engine is in operation with fuel supplied to the engine from the fuel tank, estimate whether a temperature of a catalyst would exceed a criteria temperature on assumption that purge gas is supplied to the engine in a state where a fuel supply from the fuel tank to the engine is stopped, and in a case where the temperature of the catalyst is estimated to exceed the criteria temperature, increase an amount of the fuel supply to the engine before the fuel supply to the engine is stopped to decrease the temperature of the catalyst such that the temperature of the catalyst becomes equal to or lower than the criteria temperature when the fuel supply to the engine is stopped.

8. The evaporated fuel processing device according to claim 1, wherein in the case where the temperature of the catalyst is estimated to exceed the criteria temperature, the controller stops a purge gas supply to the intake pipe.

9. The evaporated fuel processing device according to claim 1, wherein in the case where the temperature of the catalyst is estimated to exceed the criteria temperature, the controller calculates an amount of the purge gas by which the temperature of the catalyst does not exceed the criteria temperature and reduces a supply amount of the purge gas to the calculated amount.

* * * * *